United States Patent [19]

Burnett

[11] 3,936,625

[45] Feb. 3, 1976

[54] ELECTROMAGNETIC INDUCTION HEATING APPARATUS

[75] Inventor: Henry J. Burnett, West Hartford, Conn.

[73] Assignee: Pollutant Separation, Inc., Elmwood, Conn.

[22] Filed: Mar. 25, 1974

[21] Appl. No.: 454,675

[52] U.S. Cl. ..... 219/10.51; 219/10.75; 219/10.79

[51] Int. Cl.[2] ..... H05B 5/08

[58] Field of Search..... 219/10.51, 10.49, 10.77, 219/10.75, 10.79; 336/60, 61

[56] References Cited

UNITED STATES PATENTS

| | | | |
|---|---|---|---|
| 1,122,892 | 12/1914 | Farrand | 219/10.51 |
| 1,750,640 | 3/1930 | Kittredge et al. | 219/10.51 |
| 1,818,953 | 8/1931 | Holmes | 219/10.51 |
| 2,329,693 | 9/1943 | Black | 219/10.49 |
| 2,616,022 | 10/1952 | Arnaud | 219/10.51 |
| 3,534,197 | 10/1970 | Burnett | 219/10.51 X |
| 3,663,910 | 5/1972 | Grubb | 336/60 X |
| 3,824,364 | 7/1974 | Cachat | 219/10.51 |

*Primary Examiner*—Bruce A. Reynolds
*Attorney, Agent, or Firm*—McCormick, Paulding & Huber

[57] ABSTRACT

An electromagnetic induction heating apparatus comprises a heating unit which includes a tank having a removable cover and inlet and outlet openings and containing a quantity of liquid. A plurality of electromagnetic induction heaters arranged in series and releasably supported in fixed position within the tank between the inlet and outlet openings are immersed in the liquid and controlled by an external electrical control circuit to heat the liquid to a predetermined temperature. Conduits connected to the heating unit carry liquid to and from the unit and may be arranged in a closed loop to continuously recirculate heated liquid through the heating unit when the apparatus is provided to heat a building or the like or to preheat lubricating oil in a lubrication system. The apparatus may also be arranged to receive fuel oil from a supply source, preheat the oil, and supply it to a burner for firing a boiler or the like.

5 Claims, 6 Drawing Figures

ELECTROMAGNETIC INDUCTION HEATING APPARATUS

BACKGROUND OF THE INVENTION

This invention relates in general to heating apparatus and deals more particularly with improved electromagnetic induction apparatus for heating liquid. The general aim of the present invention is to provide an improved electrically operated liquid heating apparatus which may be safely operated in any environment and which includes a heating unit which contains one or more electromagnetic induction heaters releasably supported and arranged for convenient access to facilitate servicing or replacement. The apparatus of the present invention may, for example, be arranged in a closed loop to continuously circulate a quantity of liquid heated to a predetermined temperature as, for example, in a heating system for a building or in a lubrication system. The present apparatus is also particularly well suited to receive liquid such as fuel oil from a supply source or storage tank and to supply it at a higher temperature to a remote location where it may be efficiently utilized to fire a boiler or the like.

SUMMARY OF THE INVENTION

In accordance with the present invention, an improved electromagnetic induction heating apparatus is provided which comprises a tank for receiving and containing a quantity of liquid to be heated and having a removably end cover and an inlet opening and an outlet opening. A least one electromagnetic induction heater is disposed within the tank and has a core assembly which includes a magnetic core which has parallel core sections and a primary coil wound therearound. The heater further includes a plurality of parallel heater plates having openings therein which receive the core sections and coils therethrough. Mounting brackets are provided for releasably supporting the core assembly in fixed position within the container in spaced relation to the walls thereof between the inlet and outlet openings and generally within the path of fluid flow therebetween. Rods are provided for supporting the heater plates in fixed position relative to the core assembly. A temperature responsive electrical control circuit is provided for energizing the coils to induce eddy currents in the heater plates whereby to heat the liquid to a predetermined temperature.

DETAILED DESCRIPTION OF THE PREFERRED EMBODIMENT

Figure 1:
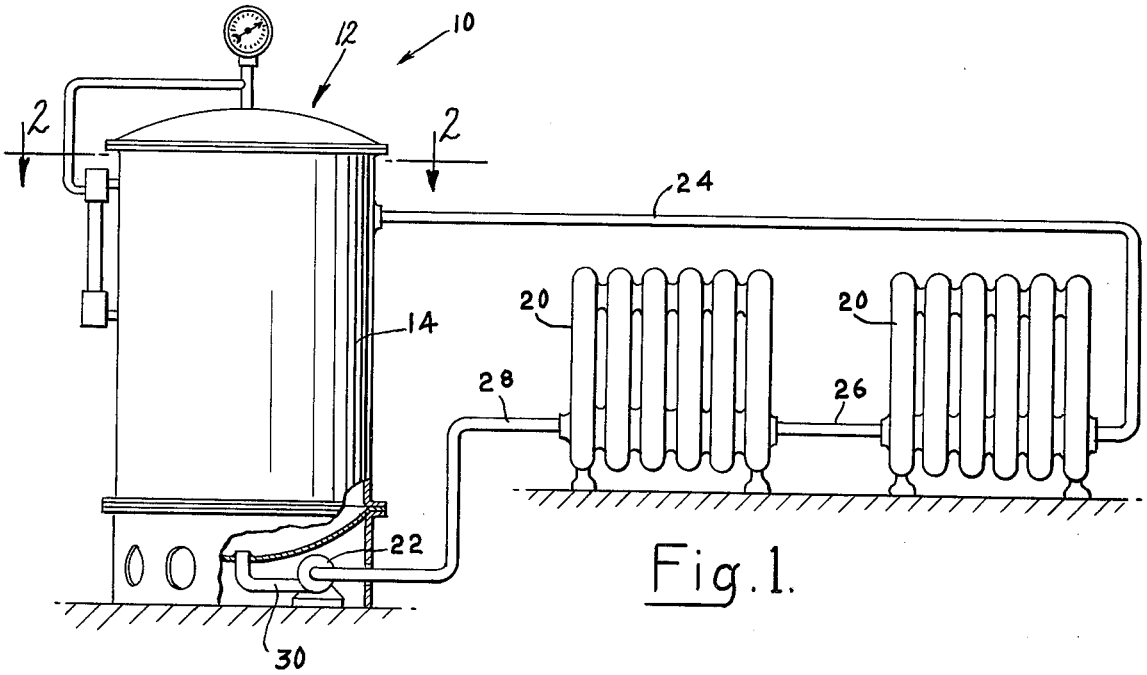
FIG. 1 is a somewhat schematic side elevational view of heating apparatus embodying the present invention.

Turning now to the drawings and referring particularly to FIGS. 1–3, the present invention is illustrated with reference to apparatus for heating a building or the like and designated generally by the reference numeral 10. The illustrated apparatus 10 comprises a heating unit indicated generally at 12 which includes a container or heater tank 14 containing a quantity of liquid, preferably oil, designated by the numeral 16 in FIG. 3. At least one electromagnetic induction heater such as indicated at 18*a* is mounted in fixed position within the tank and immersed in the liquid for heating it. The illustrated apparatus 10 comprises a closed liquid circulating system and further includes a plurality of radiation units or radiators 20, 20 connected in series with a circulating pump 22 and the heating unit 12 by conduits 24, 26, 28 and 30. The circulating pump 22 operates in response to an ambient temperature responsive control device located in the building to be heated, but not shown, as, for example, a thermostatic switch. The pump 22 circulates the heated liquid 16 through the conduits and radiator which comprise the system, in a manner well known in the art.

Considering now the heating unit 12 in further detail, the heater tank may vary in shape and may be either horizontally or vertically oriented. However, the illustrated tank 14 is generally cylindrical, supported in an axially upright position, and has a removable domed cover 32 at its upper end secured by suitable fasteners (not shown). The conduit 30 communicates with an inlet opening 34 at the lower end of the tank whereas the conduit 24 communicates with a fluid outlet opening 36 in the upper portion of the tank 14. A sight guage mounted on the wall of the tank provides visible indication of the level of the liquid 16 and a conventional pressure guage provides indication of tank pressure. The tank 14 may also be provided with a suitable pressure-relief valve (not shown) to prevent development of excessive pressure therein.

The number of electromagnetic induction heaters mounted in the heater unit 12 may vary. The illustrated heating unit 12 has three electromagnetic heaters designated 18a, 18b and 18c and supported in vertical series within the tank 14 generally between an inlet opening 34 and an outlet opening 36, respectively defined by the conduits 30 and 24, and disposed generally in the fluid flow path therebetween, the latter flow path being indicated generally by flow arrows in FIG. 3.

Figure 2:
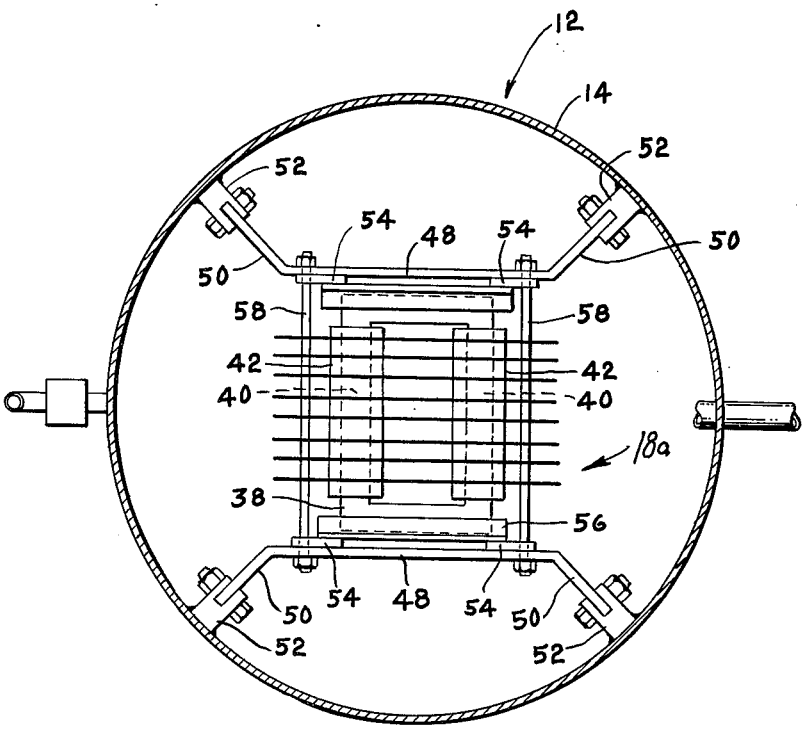
FIG. 2 is a somewhat enlarged sectional view taken generally along the line 2—2 of FIG. 1.
Figure 3:
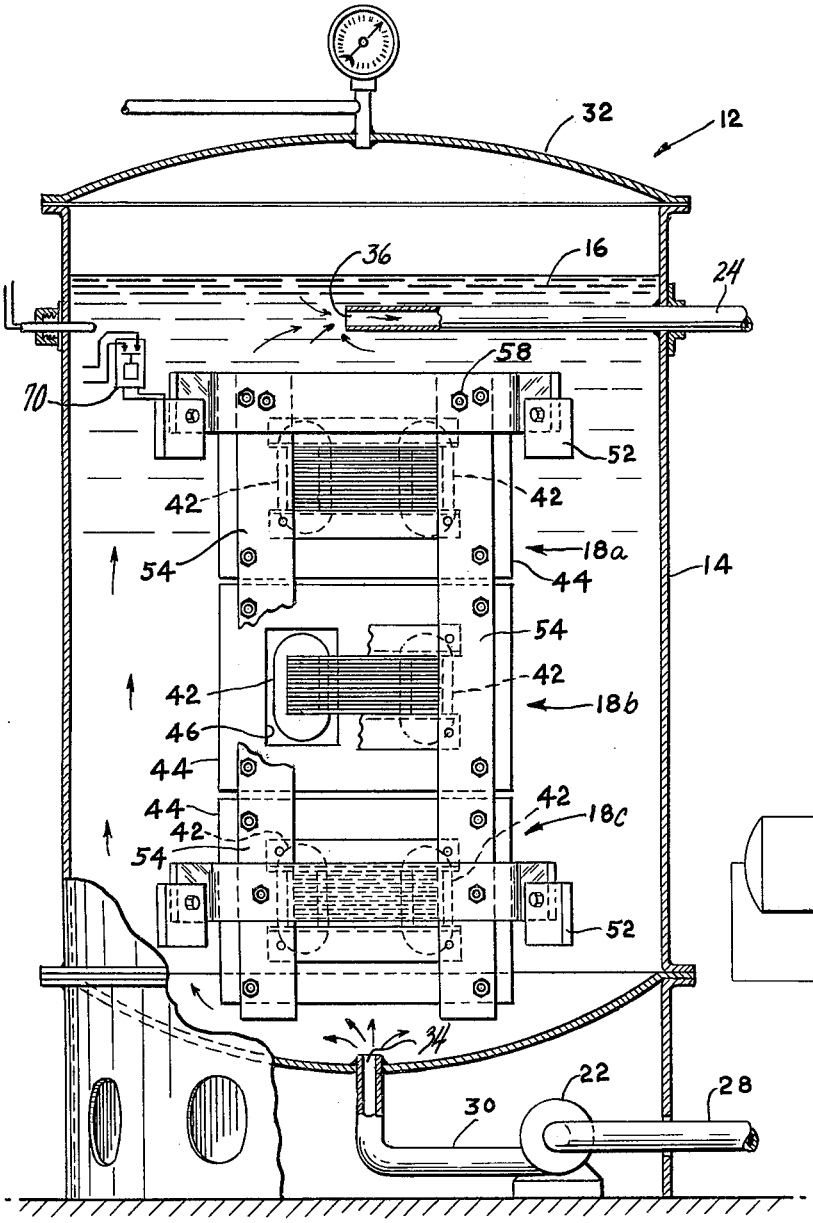
FIG. 3 is a somewhat enlarged fragmentary side elevational view of the heating apparatus of FIG. 1, a portion of the tank shown in vertical section to reveal heaters contained therein.

Referring now particularly to FIGS. 2 and 3, a typical electromagnetic induction heater, such as the heater 18a, has a core assembly which includes a generally rectangular laminated magnet core 38 which has horizontally disposed parallel core sections 40, 40 and a primary coil 42 wound around each of the core sections 40, 40, as best shown in FIG. 2. Each heater unit further includes a plurality of parallel heater plates 44, 44 which act as electrical secondaries in which eddy currents are induced to produce heat and which have openings 46, 46 therein to receive the core sections 40, 40 and the coils 42, 42 therethrough whereby the heater plates 44, 44 generally surround the core sections and the coils.

Each core assembly is mounted in fixed position within the tank and in spaced relation to the walls thereof by mounting brackets attached to opposite ends of its core 38. Each mounting bracket 48 has radially outwardly extending legs 50, 50. The outer end of each leg 50 is received and releasably retained in an upwardly opening slot formed in an associated boss 52 welded or otherwise suitably secured to the inner surface of the tank 14. The mounting brackets 48, 48 are or may be bolted to the bosses 52, 52 by fasternern 53, 53 substantially as shown in FIG. 2. In the illustrated embodiment, the three heaters 18*a–c* are supported in vertical series by upper and lower mounting brackets 48, 48 connected together by parallel vertically extending support members 54, 54. An associated end of each core 38 is supported in fixed position between a pair of angle brackets 56, 56 mounted on each pair of support members 54, 54 and extending transversely therebetween. The heater plates 44, 44 are supported on rods 58, 58 which have threaded ends to receive nuts and extend between the plates 54, 54 at opposite ends of the core 38. Suitable spacers may be provided along the rods for maintaining the heater plates 44, 44 in spaced relation to each other and to the plates 54, 54. Preferably, the openings 46, 46 in the heater plates 44, 44 are substantially larger than the coils 42, 42 which extend therethrough so that the rods 58, 58 support the heater plates 44, 44 in spaced relation to the coils 42, 42.

Figure 4:
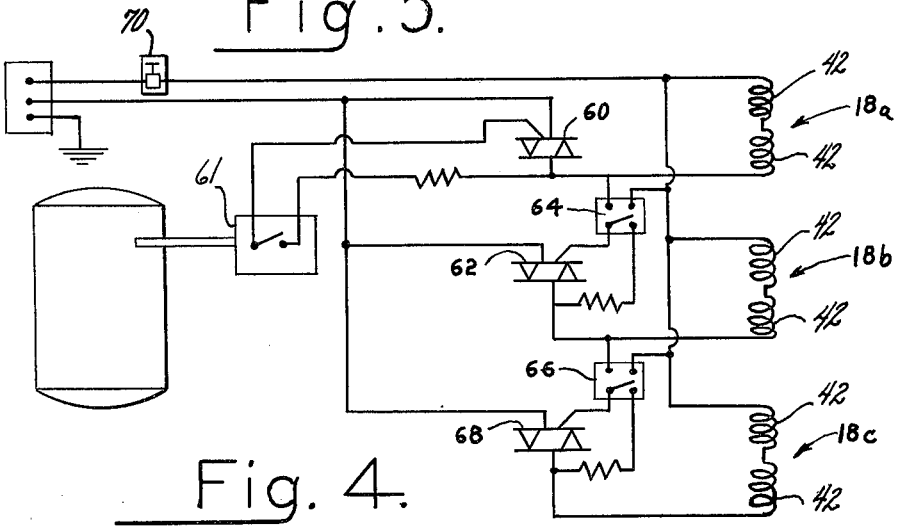
FIG. 4 is a diagrammatic view of a preferred electrical control circuit for the heating apparatus of FIG. 1.

The heaters 18, 18 are arranged for sequential operation in response to the ambient temperature sensing device immersed in the heating liquid 16. This arrangement avoids risk of circuit overload when the heaters are energized. Referring now to the circuit diagram of FIG. 4, a triac 60 is connected in series between the heater 18*a* and an AC power supply source. The gate trigger circuit for the triac 60 is connected to a temperature responsive switch or immersion thermocouple switch 61, which senses the temperature of the oil 16 and operates at a predetermined temperature, to energize the trigger circuit. Operation of the second inner 18b is controlled by another triac 62 which has its gate circuit connected to a time delay switch 64 arranged to operate to provide a predetermined time delay after the first heater 18*a* has been turned on. Another gate circuit associated with the third heater 18*c* and responsive to operation of the second heater 18*b* includes a time delay switch 66 which triggers a triac 68 associated with the third heater 18*c* to turn on the latter heater. The illustrated circuit also includes a low level cut-out switch 70 which operates to shut off all of the heaters in the event that the level of the liquid in the tank 14 falls below a predetermined level. It will now be apparent that any number of heaters may be provided to meet the requirements of the particular system, the heaters being generally arranged to operate sequentially as hereinbefore described.

When the apparatus 10 is in operation, the circulating pump 22 operates to circulate hot liquid through the conduits and associated radiators 20, 20 in response to a suitable room thermostat or the like (not shown). When the temperature of the liquid 16 reaches a predetermined low limit, the thermocouple switch operates to sequentially energize the heaters 18*a*, 18*b* and 18*c* as hereinbefore discussed.

Figure 5:
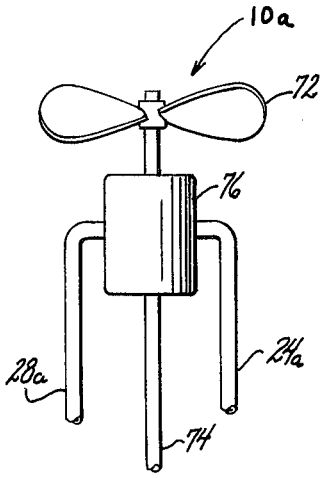
FIG. 5 is a fragmentary plan view of another apparatus embodying the present invention.

The apparatus of the present invention may take other forms and may be utilized to heat liquid for other purposes. Referring now to FIG. 5, a fragmentary portion of another apparatus embodying the present invention is indicated generally at 10*a*. The apparatus 10*a* is particularly adapted to heat oil in a lubricating system wherein a part to be lubricated is exposed to relatively low temperature which tends to increase the viscosity of the lubricant. The illustrated apparatus 10*a* includes a drive unit which comprises a propeller 72 mounted on a drive shaft 74 and which may, for example, comprise a portion of the propulsion mechanism for a surface vessel, submarine or the like. The shaft 74 is journalled in a bearing 76 which may be disposed a substantial distance below the surface of water and, therefore, potentially exposed to relatively low temperature. Inlet and outlet conduits 28*a* and 24*a* are connected to an associated heating unit (not shown), such as the heating unit 12 previously described. The apparatus 10a comprises a closed loop lubricating system and preferably also includes a circulating pump such as the pump 22 to provide a continuous circulating supply of heated lubricant to the bearing 76.

Figure 6:
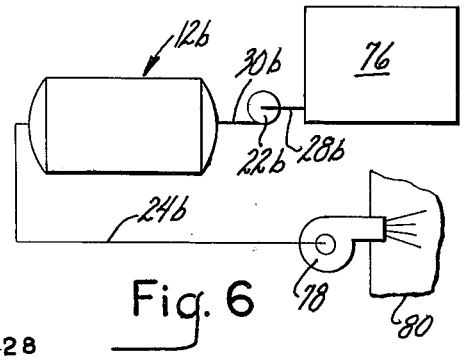
FIG. 6 is a schematic fragmentary side elevational view of still another apparatus embodying the present invention.

Referring now to FIG. 6, another apparatus embodying the invention is illustrated schematically and indicated generally at 10*b*. The apparatus 10*e* is particularly adapted for preheating bunker fuel or the like used to fire a boiler. As shown, fuel oil contained in a supply tank 77 is force fed to a heating unit 12*b* through conduits 28*b* and 30*b* by a pump 22*b*.

The heating unit 12*b* is substantially identical to the heating unit 12 previously described, but as shown, is oriented in a generally horizontal position, the inlet and outlet conduits 30*b* and 24*b* being respectfully connected to opposite ends thereof. The outlet conduit 24*b* supplies preheated fuel oil to a conventional oil burner 78 which fires a boiler 80. When the apparatus comprises a fuel preheating system of the aforedescribed general type, additional conventional safety controls may be provided and electrically interlocked with the circuit network which controls the heaters associated with the heater unit 12*b*, as is well known in the art.

In the preceeding description and in the claims which follow the terms upper, lower, horizontal and vertical are employed for convenience to describe the orientation of the heater assemblies and supporting means relative to the heater tank, however, it should be understood that the tank which comprises the apparatus may be operated in either horizontal or vertical position.

I claim:

1. An electromagnetic induction heating apparatus comprising a closed tank having side and end walls and including a removable end cover providing a closure for one end thereof, said tank containing a quantity of liquid to be heated, an inlet conduit connected to an inlet opening in said tank and defining a liquid flow path into said tank from a location remote from said tank, an outlet conduit connected to an outlet opening in said tank and defining a liquid flow path out of said tank to a location remote from said tank, a pump connected in series with one of the conduits, at least one electromagnetic induction heater assembly disposed within said tank between said inlet and outlet openings and wholly submerged in the liquid to be heated, said heater assembly including a generally rectangular magnet core having parallel core sections, primary coils wound on said core sections and connected in electrical series, support members attached to opposite ends of said magnet core, a plurality of rods attached to and extending between said support members in spaced relation to said core and in generally parallel relation to said core sections, a spaced apart series of vertically disposed heater plates carried by said rods, said heater plates comprising electrical secondaries in which eddy currents are induced and having openings therein receiving therethrough said core sections and said primary coils wound thereon, said heater plate openings being substantially larger than associated portions of said core sections and said primary coils received therethrough, said rods maintaining said heater plates in spaced relation to each other and in spaced relation to said primary coils and said core sections, means for supporting said heater assembly including mounting brackets attached to said support members at opposite ends of said core, each of said brackets having legs extending outwardly from its associated support member and in the direction of said side wall, a plurality of mounting bosses equal in number to said legs, each of said mounting bosses secured to the inner surface of said side wall and having a slot therein opening in the direction of said one end receiving an outer end portion of an associated leg therein, and fasteners releasably securing said legs to said bosses, and electrical control means responsive to the temperature of the liquid in said tank for energizing said primary coils whereby to induce eddy currents in said heater plates to heat the liquid in said tank and to maintain it at a substantially predetermined temperature.

2. An electromagnetic induction heating apparatus as set forth in claim 1 wherein said outlet conduit communicates with said inlet conduit externally of said tank forming a closed loop conduit system and said system comprises a building heating system and includes a plurality of radiation units connected in series in said conduit system.

3. An electromagnetic induction heating apparatus as set forth in claim 1 wherein said outlet conduit communicates with said inlet conduit externally of said tank forming a closed loop conduit system, said apparatus includes a bearing connected in series with said conduit system, and said liquid comprises a lubricant.

4. An electromagnetic induction heating apparatus as set forth in claim 1 for preheating fuel oil wherein said fuel oil comprises said liquid, said inlet conduit is connected to a fuel oil source at a location remote from said tank to receive fuel oil therefrom, and said outlet conduit is connected to an oil burner at another location remote from said tank to supply fuel oil thereto.

5. An electromagnetic induction heating apparatus as set forth in claim 1 including a plurality of electromagnetic induction heater assemblies supported in spaced series by said support members and wherein said temperature responsive control means comprises means for sequentially energizing said heater assemblies.

* * * * *